United States Patent [19]

Sugano et al.

[11] 3,992,269

[45] Nov. 16, 1976

[54] PRODUCTION OF PINACOLS IN A MEMBRANE CELL

[75] Inventors: Thomas T. Sugano, Painesville; Barry A. Schenker, Mayfield Heights; Joseph A. Walburg, Mentor-on-the-Lake; Nicholas Shuster, Willoughby Hills, all of Ohio

[73] Assignee: Diamond Shamrock Corporation, Cleveland, Ohio

[22] Filed: Nov. 3, 1975

[21] Appl. No.: 628,390

[52] U.S. Cl. ..... 204/77

[51] Int. Cl.[2] ..... C25B 3/04; C25B 3/10; C25B 13/00

[58] Field of Search ..... 204/73 R, 76, 77

[56] References Cited

UNITED STATES PATENTS

| | | | |
|---|---|---|---|
| 2,422,468 | 6/1947 | Chambers et al. | 204/77 |
| 2,485,258 | 10/1949 | Chambers et al. | 204/77 X |
| 3,899,401 | 8/1975 | Nohe et al. | 204/59 R |

FOREIGN PATENTS OR APPLICATIONS

| | | | |
|---|---|---|---|
| 465,652 | 6/1950 | Canada | 204/77 |
| 306,304 | 12/1919 | Germany | 204/77 |

*Primary Examiner*—F.C. Edmundson
*Attorney, Agent, or Firm*—Bruce M. Winchell

[57] ABSTRACT

Disclosed is an improved method for the electrochemical production of pinacols from organic carbonyl compounds at high current efficiency in an acid medium in a cell having a hydraulically impermeable cation-exchange membrane. Aqueous organic carbonyl compound and sulfuric acid are introduced to the cathode compartment of the cell along with copper ions in controlled concentrations. After passing an electrolyzing current between the anode and cathode of the cell the pinacol is recovered from the cathode compartment effluent.

10 Claims, 5 Drawing Figures

PRODUCTION OF PINACOLS IN A MEMBRANE CELL

BACKGROUND OF THE INVENTION

The present invention relates generally to a method for preparing pinacols from organic carbonyl compounds electrochemically. More particularly it relates to an improved process for electrochemically producing pinacols in a cell having a hydraulically impermeable cation-exchange membrane, an acid medium, and careful concentration control of the materials charged to the cell.

Pinacols are intermediates which are useful in the preparation of polymers, pharmaceutical products and pesticides but have been avoided as a synthesis route to these products because only unsatisfactory methods of manufacturing the pinacols are available today. Electrolytic reduction or couping of acetone to form pinacol, (2,3-dimethyl-2,3-butanediol), has been carried out on an experimental basis for a number of years to produce small quantities of pinacol. Such processes though have thus far failed to receive much commercial utilization because of the cost factors involved in these methods which employ quantenary ammonium salts and porous separators, resulting in low current efficiencies.

SUMMARY OF THE INVENTION

It is therefore an object of the present invention to provide a method for electrochemically producing pinacols at higher efficiency and lower cost within the range of commercial utilization.

It is another object of the present invention to provide a method for electrochemical production of pinacols in a way that will be safer and environmentally more acceptable.

These and other objects of the present invention, and the advantages thereof over the prior art forms, will become apparent to those skilled in the art from the detailed disclosure of the present invention as set forth hereinbelow.

It has been found that pinacol of the formula

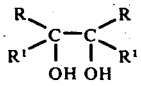

where R is a hydrocarbon radical of one to six carbon atoms, $R^1$ is hydrogen or a hydrocarbon radical of one to six carbon atoms, by the electrochemical reduction of organic carbonyl compounds of the formula R—CO—$R^1$ where R and $R^1$ have the above meaning by: introducing aqueous sulfuric acid to the anode compartment of an electrolytic cell divided into anode and cathode compartments by a hydraulically impermeable, cation-exchange membrane, in an amount sufficient to conduct an electrolyzing current; introducing an aqueous solution of organic carbonyl compound, acid, and copper ions to the cathode compartment of the electrolytic cell, passing a direct, electrolyzing current between the anode and cathode of the electrolytic cell; and recovering the pinacol from the cathode compartment effluent. This method results in a significantly increased current efficiency in an electrolytic cell.

The preferred embodiments of the process for production of pinacol are shown by way of example in the accompanying drawings without attempting to show all of the various forms and modifications in which the invention might be embodied; the invention being measured by the appended claims and not by the details of the specification.

DESCRIPTION OF THE PREFERRED EMBODIMENTS

Figure 1:
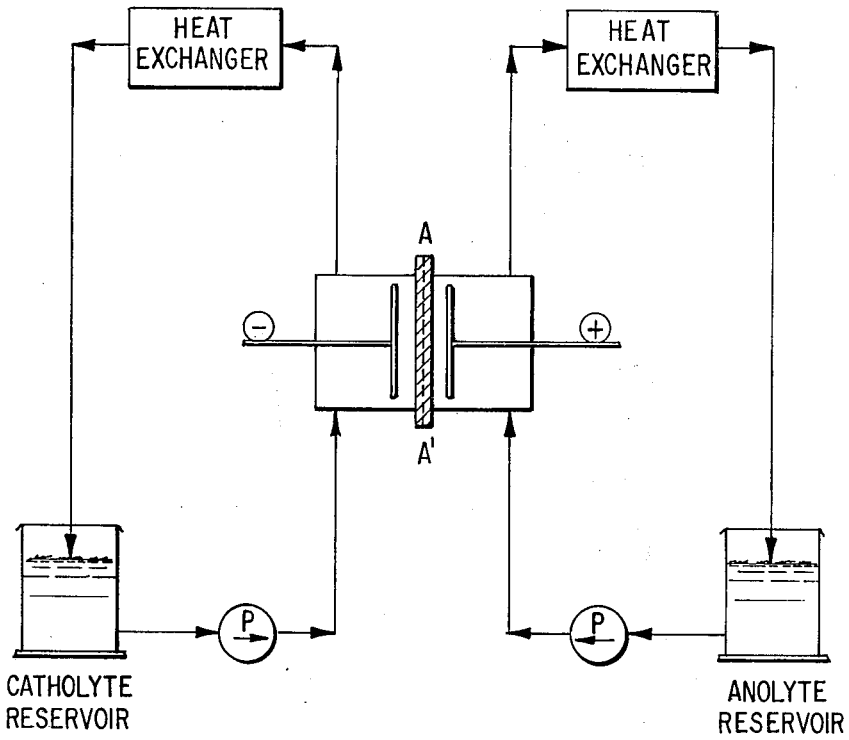
FIG. 1 is a diagrammatic view of a system for producing pinacol by a batch process.

Pinacols can be produced electrochemically by reducing organic carbonyl compounds at the cathode of an electrolytic cell. The basic reaction can be described as follows:

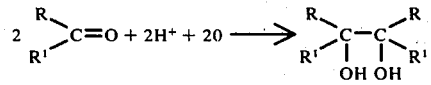

1.

and if the starting material is acetone, the reaction is

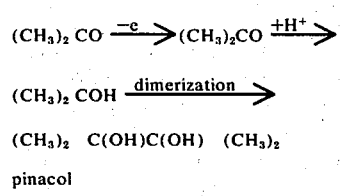

2.

Acetone, it has been found, yields the best results according to the method of the present invention.

During this reaction there are other competing reactions which should be minimized. Among these by-products are propane, isopropyl alcohol, diacetone alcohol (4-hydroxy-4-methyl-2-pentanone), mesityl oxide (4-methyl-3-pentene-2-one) and hydrogen.

The reaction producing pinacol will be favored by using an acid medium such as aqueous sulfuric acid. The reaction is carried out in an electrolytic cell generally having an enclosure which is divided into two compartments by the hydraulically impermeable cation-exchange membrane. In one compartment is disposed an appropriate cathode, generally a metallic material, such as chemical lead. The other compartment contains the anode, a conductive, electrocatalytically active material, suitable for an oxygen evoluting environment such as dimensionally stable anode, e.g., a titanium substrate bearing a coating of a platinum group metal, platinum group metal oxide, or other electrocatalytically active, corrosion resistant material. A platinum-iridium coated mesh is one example.

One type of hydraulically impermeable cation-exchange membrane used in the present process is a thin film of fluorinated copolymer having pendant sulfonic acid groups. The fluorinated copolymer is derived from monomers of the formula $$7.\ FO_2S\text{-}(R)_n\text{-}CF=CF_2$$

in which the pendant $-SO_2F$ groups are converted to $-SO_3H$ groups, and monomers of the formula $$8.\ CXX^1=CF_2$$

wherein R represents the group $$-\underset{}{\overset{R^1}{\overset{|}{C}}}F-CF_2-O\text{-}(CFY-CF_2O)_m$$

in which $R^1$ is fluorine or perfluoroalkyl of 1–10 atoms; Y is fluorine or trifluoromethyl; $m$ is 1,2, or 3; $n$ is 0 or 1; X is fluorine chlorine or trifluoromethyl; and $X^1$ is X or $CF_3\text{-}(CF_2)_a$ wherein $a$ is 0 or an integer from 1 to 5.

This results in copolymers used in the membrane for the cell having the repeating structural units $$9.\quad -\overset{F}{\overset{|}{\underset{\underset{SO_3H}{|}}{\underset{\underset{(R)_n}{|}}{C}}}}-CF_2-$$

and $$10.\ -CXX^1-CF_2-$$

In the copolymer, there should be sufficient repeating units according to formula (9) to provide an $-SO_3H$ equivalent weight of about 1000 to 1400. Membranes having a water absorption of about 25% or greater are preferred since higher cell voltages at any given current density are required for membranes having less water absorption. Similarly, membranes having a film thickness (unlaminated) of about 8 mils or more, require higher voltages in the process of the present invention and, thus, have a lower power efficiency.

Typically, because of the large surface areas of the membranes present in commercial cells, the membrane film will be laminated to and impregnated into a hydraulically permeable, electrically non-conductive, inert, reinforcing member, such as a woven or nonwoven fabric made from fibers of asbestos, glass, TEFLON or the like. In film/fabric composite membranes, it is preferred that the laminating produce an unbroken surface of the film resin on both sides of the fabric to prevent leakage through the membrane caused by seepage along the fabric yarns. For some reinforcing fabrics this may best be achieved by laminating a film of the copolymer on each side of the fabric. When this is done the thickness of the membrane film will be the sum of the two films thicknesses.

The hydraulically impermeable cation-exchange membranes of the type in question are further described in the following patents which are hereby incorporated by reference: U.S. Pat. Nos. 3,041,317; 3,282,875; 3,624,053; British Pat. No. 1,184,321 and Dutch Published Application No. 72/12249. Membranes as aforedescribed are available from E. I. Du- Pont de Nemours & Co. under the trademark NAFION.

Another type of hydraulically impermeable cation-exchange membrane used in the present method is a film of a polymeric substance having pendant sulfonic acid groups. The polymeric backbone is derived from the polymerization of a polyvinyl aromatic component with a monovinyl aromatic component in an inert organic solvent under conditions which prevent solvent evaporation to result in generally a copolymeric substance although a 100 percent polyvinyl aromatic compound may be prepared which is satisfactory.

The polyvinyl aromatic component may be chosen from the group including: divinyl benzenes, divinyl toluenes, divinyl napthalenes, divinyl diphenyls, divinyl-phenyl vinyl ethers, the substituted alkyl derivatives thereof such as dimethyl divinyl benzenes and similar polymerizable aromatic compounds which are polyfunctional with respect to vinyl groups.

The monovinyl aromatic component which will generally be the impurities present in commercial grades of polyvinyl aromatic compounds include: styrene, isomeric vinyl toluenes, vinyl napthalenes, vinyl ethyl benzenes, vinyl chlorobenzenes, vinyl sylenes, and alpha substituted alkyl derivatives thereof, such as alpha methyl vinyl benzene. In cases where high-purity polyvinyl aromatic compounds are used, it may be desirable to add monovinyl aromatic compounds so that the polyvinyl aromatic compound will constitute 30 to 80 mole percent of polymerizable material.

Suitable solvents in which the polymerizable material may be dissolved prior to polymerization should be inert to the polymerization (in that they do not react chemically with the monomers or polymer), should also possess a boiling point greater than 60° C, and should be miscible with the sulfonation medium.

Polymerization is effected by any of the well known expedients for instance, heat, pressure, and catalytic accelerators, and is continued until an insoluble, infusible gel is formed substantially throughout the volume of solution. The resulting gel structures are then sulfonated in a solvated condition and to such an extent that there are not more than four equivalents of sulfonic acid groups formed for each mole of polyvinyl aromatic compound in the polymer and not less than one equivalent of sulfonic acid groups formed for each ten mole of poly- and monovinyl aromatic compound in the polymer. As with the NAFION type membrane these materials may require reinforcing of similar materials.

Hydraulically impermeable cation-exchange membranes of this second type are further described in the following patents which are hereby incorporated by reference: U.S. Pat. Nos. 2,731,411; and 3,887,499. Membranes of the second type are available from Ionics, Inc. under the trademark IONICS CR6..

This type of electrolytic cell operation can be run as a closed system thereby eliminating the evaporation of acetone into the surrounding atmosphere which has heretofore present a safety problem and an environmentally unacceptable situation. The danger of inhalation of acetone vapor or ignition of this explosive vapor is significantly reduced and there is no vapor to escape into the environment.

The present invention can be operated either as a batch or a continuous process. In a typical batch procedure, as seen in FIG. 1, aqueous acetone concentration of 200 to 500 grams per liter with preferred range of 350 to 425 grams per liter and copper sulfate to yield a copper ion concentration of 1 to 200 ppm with a preferred range of 8 to 15 ppm are charged into the cathode compartment of an electrolytic cell separated into a cathode compartment and an anode compartment by a hydraulically impermeable cation-exchange membrane $AA^1$ seen in FIG. 1. Aqueous sulfuric acid of a concentration of 150 to 450 grams per liter with a preferred range of 300 to 350 grams per liter is charged to the cathode compartment also. The anode compartment is charged with a dilute solution of aqueous sulfuric acid such as a five percent by weight solution.

A direct electric current, generally on the order of one half to two amperes, with one ampere being preferred, per square inch of cathode surface area, is passed between the electrodes causing generation of oxygen at the anode and production of pinacol by reduction of acetone according to equation (1) in the cathode compartment. The solution in the cathode compartment is circulated constantly through the cell as seen in the diagram of FIG. 1, to provide a good mixing and turbulence in order to promote more effective mass transfer to and from the cathode surface. It is believed that the circulation rate will generally be higher and more critical in larger cells to achieve a good current efficiency. The anolyte is also circulated as shown in FIG. 1.

Electric current in the cell is carried primarily by H+ species (along with associated water molecules) traveling through the membrane from the anode compartment to the cathode compartment. A small amount of acetone diffuses through the membrane in the opposite direction but this is minimized when the cell is in operation because the acetone must diffuse against the direction of travel of the $H+ \ldots H_2O$ species. The hydraulically impermeable cation-exchange membranes have helped to minimize this migration of acetone into the anode compartment which was a serious drawback of the prior art methods using porous separators. It is believed that the prior art cells permitted rapid diffusion of the acetone into the anode compartment causing a decrease in acetone concentration in the cathode compartment which had a deleterious effect upon the kinetics of the desired reduction of acetone to pinacol. It is also believed that pinacol was permitted to migrate into the anode compartment and oxidized back to acetone and that perhaps, other oxidation products migrated from the anode compartment into the cathode compartment where they poisoned the desired reaction.

The pinacol can be recovered from the effluent of the cathode compartment as pinacolone (3,3-dimethyl-2-butanone) by the process of distillation of the catholyte effluent.

Figure 2:
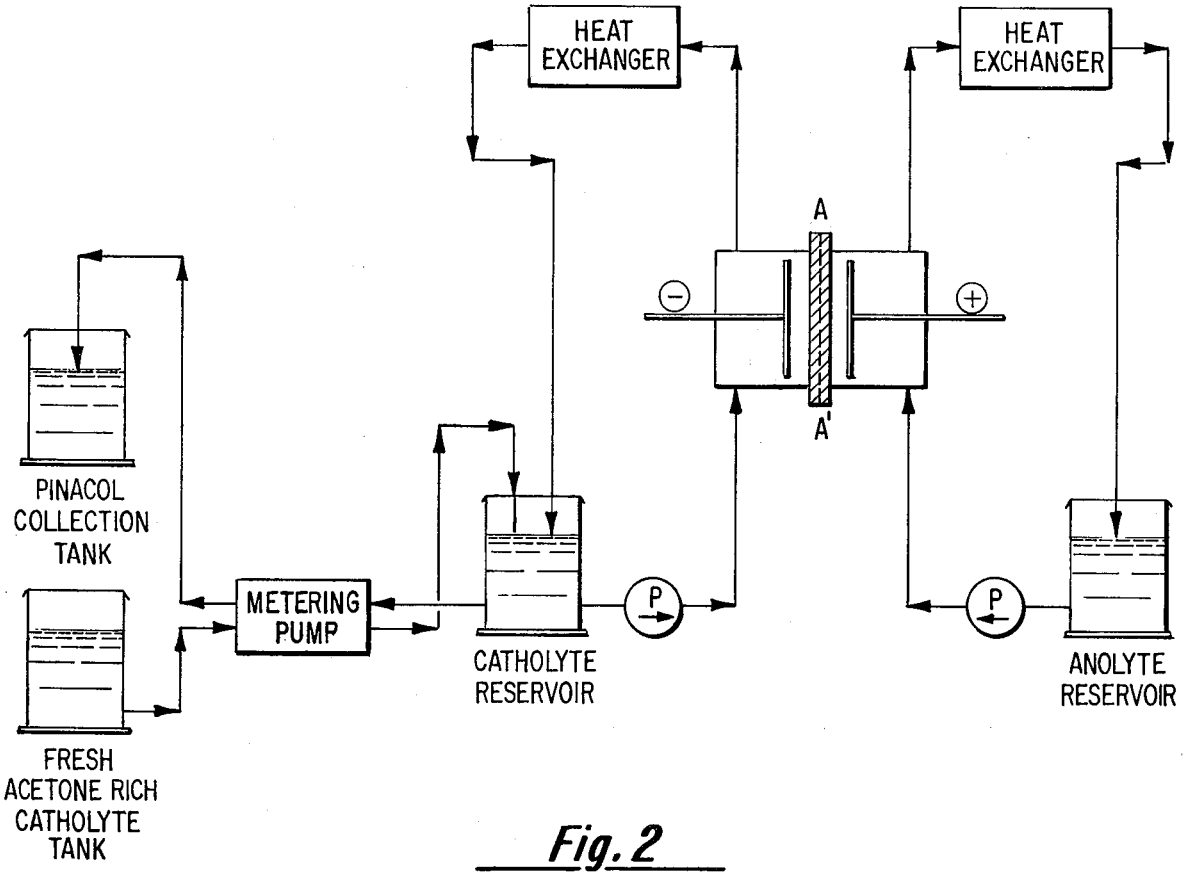
FIG. 2 is a diagrammatic view of a system for producing pinacol by a continuous process.

In a typical continuous cell operation as seen in FIG. 2, the electrolytic cell is fitted with a circulation system to the anode compartment and a separate circulation system to the cathode compartment. The cathode compartment circulation system has a reservoir to which fresh acetone rich catholyte solution is added to be metered into the cathode compartment circulation system and product is recovered from the cathode compartment circulation system once the cell has achieved a steady state of acetone and pinacol concentrations. The ingredients are charged to the cell initially in the same manner as for a batch process hereinabove described except that the volumes are larger to provide for the reservoirs of each circulation system.

A direct electrolyzing current is passed through the cell in the same way as for the batch process. Samples must then be taken from the cathode compartment circulation system reservoir periodically to determine the pinacol concentration thereof. When the pinacol concentration reaches approximately 30 grams per liter, a metering feed system is started which adds acetone to the cathode compartment circulation system reservoir at a constant controlled rate to maintain the steady state. Simultaneously therewith a metering withdrawing system is started to retrieve pinacol from the cathode compartment circulation system reservoir at the exact same rate as the feed of acetone to the anode compartment circulating system reservoir. Further sampling from the cathode compartment circulating system reservoir will enable those skilled in the art to set the rate of feed and recovery to maintain a steady state of pinacol concentration within the cathode compartment. Steady state under the above stated conditions will generally occur around 19 hours after startup of the electrolytic cell.

Figure 3:
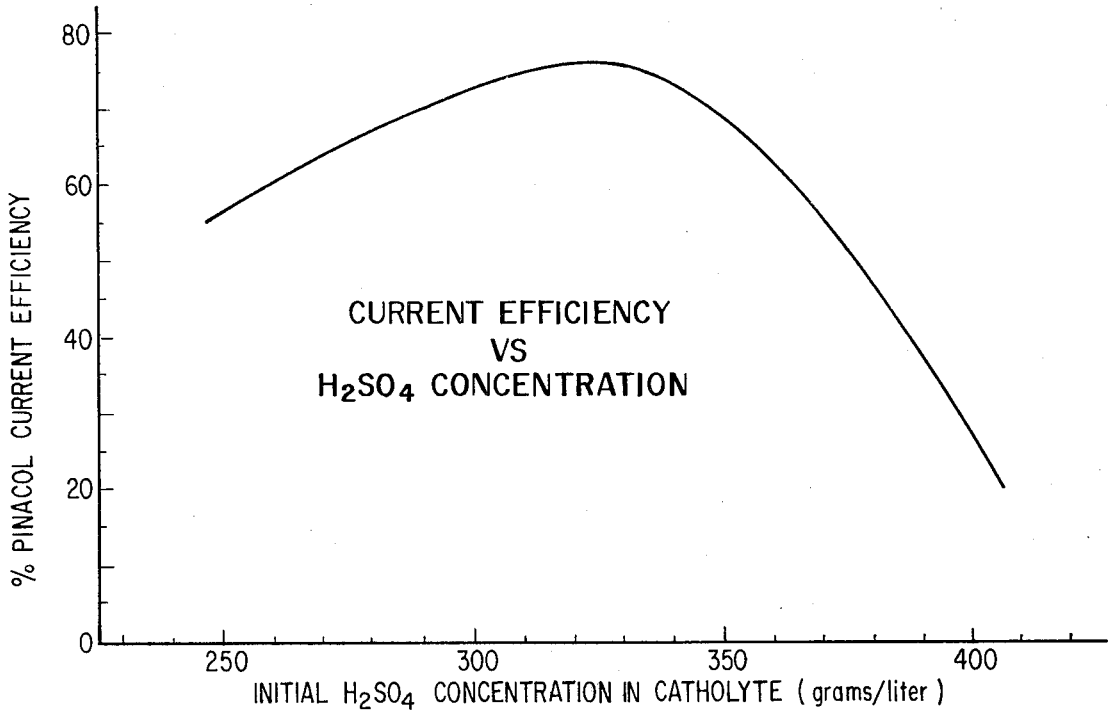
FIG. 3 is a graph showing a curve established by ploting a starting acid concentration on the abscissa versus the resulting current efficiency on the ordinate.
Figure 4:
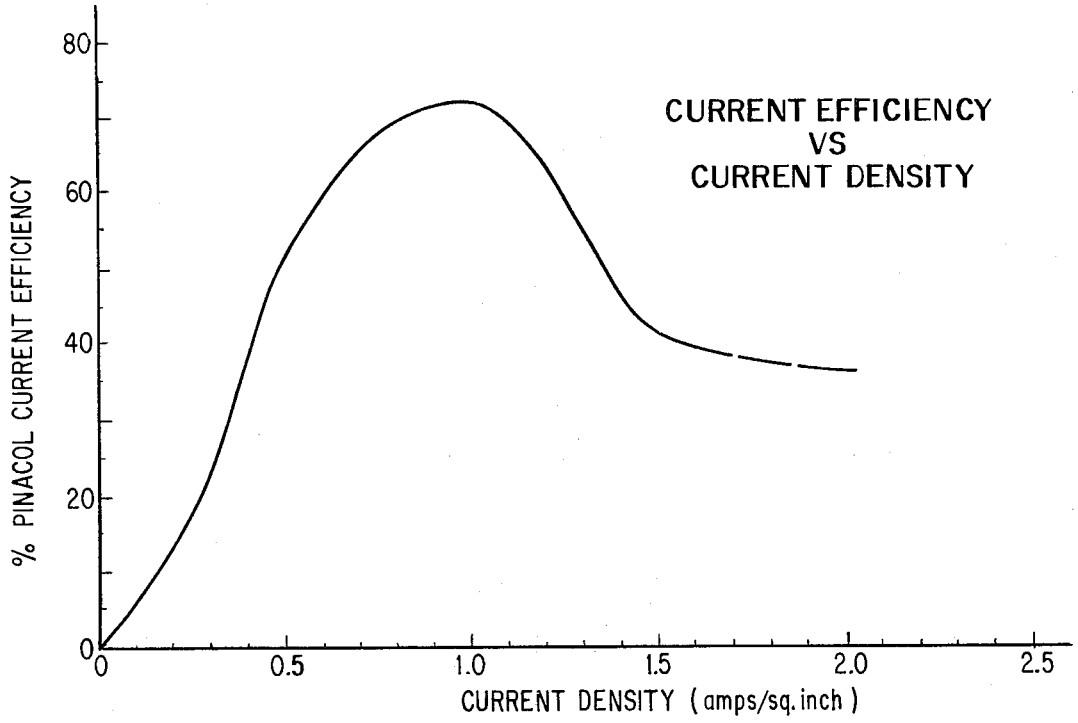
FIG. 4 is a graph showing a curve established by ploting a current density on the abscissa versus the resulting current efficiency on the ordinate.
Figure 5:
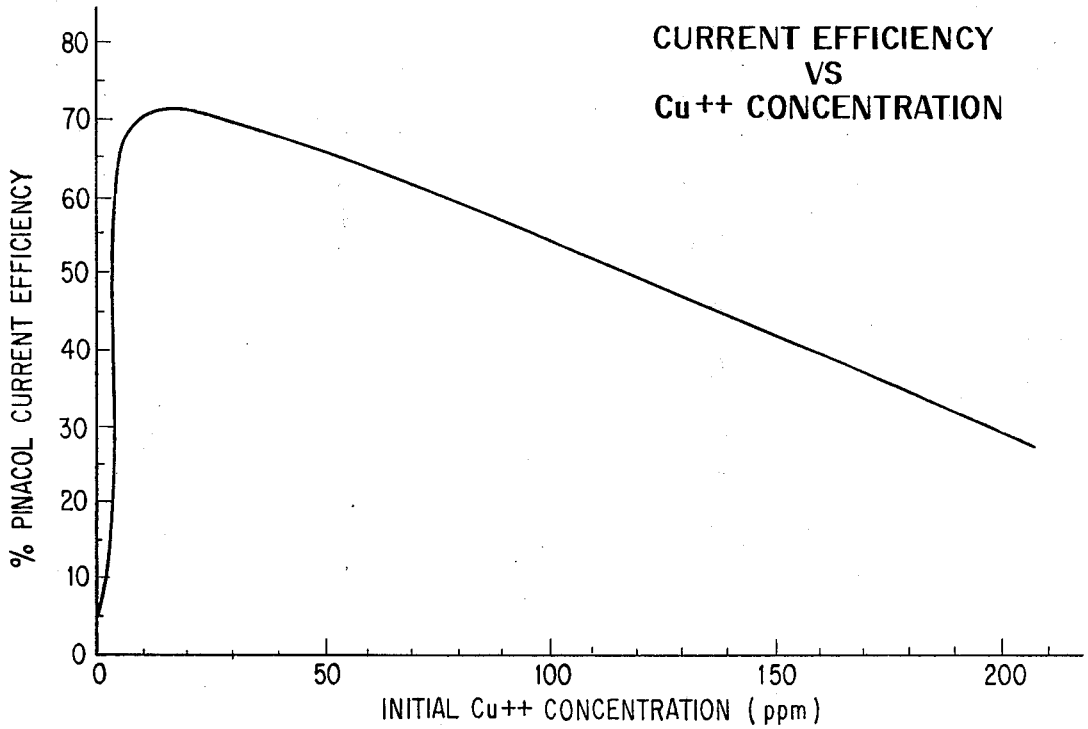
FIG. 5 is a graph showing a curve established by ploting a starting copper concentration on the abscissa versus the resulting current efficiency on the ordinate.

Experimentation has shown that a number of factors should be controlled to maximize the efficiency of the process of the present invention. Among these factors are the acetone concentration, copper ion concentration, and the acid concentration in the cathode compartment. For a batch system FIG. 3 shows a plot of the pinacol current efficiency on the ordinent versus the acid starting content of the abscissa in terms of concentration within the cathode compartment. The plot shows that at approximately 320 grams per liter of acid in the cathode compartment, there is a maximizing of the current efficiency within the cell. Also in the terms of the batch process FIG. 4 shows a plot of the pinacol current efficiency on the ordinent versus the current density plotted on the abscissa wherein approximately one amp per square inch of cathode surface area maximizes the current efficiency within the batch system process. FIG. 5 shows a plot of starting copper ion concentration on the abscissa versus the percent pinacol current efficiency on the ordinate. It should be noted that there is a sharp increase in current efficiency between 0 and 25 ppm and that there is slow falling off of current efficiency on up to 200 ppm copper ion concentration. It is also believed that this is somewhat volume dependent because copper is being plated out during operation of the electrolytic cell. It has also been found that an increased circulation rate within the cathode compartment aids mass transfer and this higher flow velocity results in an increase in the average current efficiency. Additionally this permitted the elimination of a water wash procedure of the cathode customarily done between runs of the cell. Metals such as iron or nickel can poison the reaction if found within the cell in amounts of 10 ppm or more.

In order that those skilled in the art may more readily understand the present invention and certain preferred aspects by which it may be carried into effect, the following specific examples are afforded.

EXAMPLES

In each of the following examples, the cathode was made of chemical lead; the anode was platinum-iridium coated titanium mesh, dimensionally stable anode. Any other anode coating suitable for an oxygen evoluting environment would work equally well. Examples 1 through 4 are batch systems and example 5 is a continuous cell operation system.

EXAMPLE 1

An electrolytic cell was assembled according to FIG. 1 with a NAFION permselective, cation exchange membrane having a thickness of 5 mils, a six square inch area, a 1200 —$SO_3H$ equivalent weight and a T-20 TEFLON fabric backing. The cathode and anode were positioned about ¾ inch and ½ inch, respectively, away from the membrane.

The initial anolyte solution was four liters of 5 wt. percent aqueous sulfuric acid. The initial catholyte volume was five liters; the aqueous composition of which was:

a. 250 grams sulfuric acid/liter
b. 350 grams acetone/liter
c. about 10 ppm $Cu^{++}$ The anolyte and catholyte solutions were circulated constantly through the cell to provide good mixing and turbulence in order to promote more effective mass transfer to and from the cathode surface, the catholyte at a rate of approximately 900 to 1000 cubic centimeters per minute. A six-ampere current was passed through the cell (current density = one ampere per square inch of membrane). The cell remained at approximately room temperature during its operation. This example yielded an overall current efficiency of 61.6% after 48 hours of operation.

EXAMPLE 2

The electrolytic cell was set up and run as described in Example 1. The initial anolyte and catholyte volumes were four liters and five liters, respectively. The aqueous catholyte composition was:

a. 300 grams sulfuric acid/liter
b. 350 grams acetone/liter
c. 19.2 ppm $Cu^{++}$ This example yielded an overall current efficiency of 72% after 54 hours of operation.

EXAMPLE 3

The electrolytic cell was set up and run as described in Example 1. The initial anolyte and catholyte volumes were four liters and five liters, respectively. The aqueous catholyte composition was:

a. 350 grams sulfuric acid/liter
b. 350 grams acetone/liter
c. about 11 ppm $Cu^{++}$ This example yielded an overall current efficiency of 77% and 78% after 30.6 hours and 47 hours, respectively.

EXAMPLE 4

An electrolytic cell was fitted with an IONICS CR61 cation-exchange membrane having a thickness of 23 mils, a six square inch area, and a polypropylene backing. The cell was run as described in Example 1.

The initial anolyte and catholyte volumes were four liters. The aqueous catholyte composition was:

a. 300 grams sulfuric acid/liter
b. 350 grams acetone/liter
c. about 11 ppm $Cu^{++}$ This example yielded an overall current efficiency of 50% after 29 hours of operation.

EXAMPLE 5

An electrolytic cell was assembled according to FIG. 2 with a NAFION permselective, cation-exchange membrane having a thickness of 5 mils, a six square inch area, a 1200 —$SO_3H$ equivalent weight and a T-20 TEFLON fabric backing. The cathode and anode were positioned about ¾ inch and ½ inch, respectively, away from the membrane.

The initial anolyte solution was four liters of 5 weight percent aqueous sulfuric acid. The initial catholyte volume was five liters; the aqueous composition of which was:

a. 320 grams sulfuric acid per liter
b. 350 grams acetone per liter
c. about 10 ppm $Cu^{++}$ The catholyte and anolyte solutions were circulated constantly through the cell, the catholyte at a rate of approximately 900 to 1000 cubic centimeters per minute. A six ampere current was passed through the cell (current density = one ampere per square inch of membrane). The cell remained at approximately room temperature during its operation. After about 19 hours of batch made operation the pinacol concentration in the catholyte had reached about 30 grams per liter, the acetone concentration had reached about 300 grams per liter and the current efficiency was about 55%. The metering pump was activated to feed fresh acetone rich catholyte solution (about 350 grams per liter) into the main catholyte reservoir at a constant rate of about 3.9 cubic centimeters per minute and simultaneously removing pinacol rich catholyte from the main catholyte reservoir at the same rate. This steady state continuous operation continued for about 31 hours at which time the current efficiency was about 40%.

Thus it should be apparent from the foregoing description of the preferred embodiment of the improved process for the production of pinacol from the reduction of acetone in an electrolytic cell, that the process herein described accomplishes the objects of the invention and solves the problems attendant to this process heretofore.

What is claimed is:

1. A process for the production of pinacol by the electrochemical reduction of acetone, which comprises: introducing aqueous sulfuric acid to the anode compartment of an electrolytic cell divided into anode and cathode compartments by a hydraulically impermeable, cation-exchange membrane, in an amount sufficient to conduct an electrolyzing current; introducing a mixture of aqueous acetone and sulfuric acid to the cathode compartment of said cell such that the initial sulfuric acid concentration is within the range of 150 to 450 grams per liter and the initial acetone concentration is within the range of 200 to 500 grams per liter; introducing copper ions such that the initial copper ion concentration in the cathode compartment is within the range of 1 to 200 ppm; passing a direct, electrolyzing current within the range of 0.5 to 1.5 amperes per sq. inch between the anode and cathode of said cell; and recovering pinacol from the cathode compartment effluent.

2. A process according to claim 1 wherein said initial copper ion concentration is within the preferred range of 8 to 15 ppm, said sulfuric acid concentration within the preferred range of 300 to 350 grams per liter, said acetone concentration within the preferred range of 350 to 425 grams per liter, and the ratio of sulfuric acid to acetone within the preferred range of 0.7:1 to 1.1:1.

3. A process according to claim 1 wherein said membrane is a NAFION membrane.

4. A process according to claim 1 wherein said membrane is an IONICS CR61 membrane.

5. A process according to claim 1 wherein the mixture contained in the cathode compartment is circulated constantly through the cell to provide a good mixing and turbulence in order to promote more effective mass transfer to and from the cathode surface.

6. A process according to claim 1 wherein the cathode is made of chemical lead.

7. A process according to claim 1 wherein the anode is one suitable for an oxygen evoluting environment.

8. A process for the production of pinacols of the formula

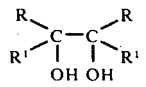

where R is a hydrocarbon radical of one to six carbon atoms, $R^1$ is hydrogen or a hydrocarbon radical of one to six carbon atoms, by the electrochemical reduction of organic carbonyl compounds of the formula R—CO—$R^1$ where R and $R^1$ have the above meaning, which comprises the steps of: introducing an aqueous solution of sulfuric acid to the anode compartment of the electrolytic cell divided into anode and cathode compartments by a hydraulically impermeable, cation-exchange membrane, in an amount sufficient to conduct an electrolyzing current; introducing an aqueous solution of organic carbonyl compound, acid and copper ions to the cathode compartment of the electrolytic cell; passing a direct, electrolyzing current between the anode and cathode of the electrolytic cell; and recovering pinacol from the cathode compartment effluent.

9. A process according to claim 8 wherein the hydraulically impermeable, cation-exchange membrane consists essentially of a film of a copolymer having the repeating structural units of the formula:

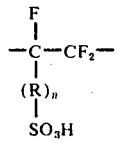

(I)

and

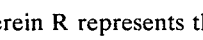

(II)

wherein R represents the group

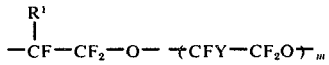

in which $R^1$ is fluorine, or perfluoralkyl of 1 to 10 carbon atoms; Y is fluorine or trifluoromethyl; *m* is 1, 2 or 3; *n* is 0 or 1; X is fluorine, chlorine, or trifluoromethyl; and $X^1$ is X or $CF_3$ $CF_2Z$ wherein Z is 0 or an integer from 1 to 5; the units of formula (I) being present in an amount to provide a copolymer having an $—SO_3H$ equivalent weight of about 1000 to 1400.

10. A process according to claim 8 wherein the hydraulically impermeable, cation-exchange membrane consists essentially of: an insoluble, infusible copolymeric matrix formed from at least 20 percent by weight of a polyvinyl aromatic compound and no more than 80 percent of a monovinyl aromatic compound with a reinforcing material therein, and no more than 70 percent by weight of a monovinyl aromatic compound without a reinforcing material therein; sulfonate groups chemically bonded to the aromatic nuclei of said matrix and a solvating liquid in gel relationship with said matrix; said sulfonate groups being present in an amount of no more than 4 equivalents of sulfonate groups for each mole of polyvinyl aromatic compound and not less that 1 equivalent of sulfonate groups for each 10 moles of poly- and monovinyl aromatic compound; said solvating liquid being at least 25 percent by volume of said resin.

* * * * *